US011695212B2

(12) United States Patent
Rogers et al.

(10) Patent No.: US 11,695,212 B2
(45) Date of Patent: Jul. 4, 2023

(54) ELECTRICALLY COUPLED BOWTIE ANTENNA

(71) Applicant: The Boeing Company, Chicago, IL (US)

(72) Inventors: John E. Rogers, Owens Cross Roads, AL (US); Ted R. Dabrowski, Madison, AL (US)

(73) Assignee: The Boeing Company, Arlington, VA (US)

( * ) Notice: Subject to any disclaimer, the term of this patent is extended or adjusted under 35 U.S.C. 154(b) by 308 days.

(21) Appl. No.: 16/820,550

(22) Filed: Mar. 16, 2020

(65) Prior Publication Data

US 2021/0288408 A1 Sep. 16, 2021

(51) Int. Cl.

| | |
|---|---|
| ***H01Q 9/28*** | (2006.01) |
| ***H01Q 1/28*** | (2006.01) |
| ***H01Q 1/48*** | (2006.01) |
| ***H01Q 1/38*** | (2006.01) |

(52) U.S. Cl.

CPC ..... *H01Q 9/28* (2013.01); *H01Q 1/286* (2013.01); *H01Q 1/38* (2013.01); *H01Q 1/48* (2013.01)

(58) Field of Classification Search

CPC .. H01Q 1/38; H01Q 9/28; H01Q 1/48; H01Q 1/286; H01Q 9/285

See application file for complete search history.

(56) References Cited

U.S. PATENT DOCUMENTS

| | | | | |
|---|---|---|---|---|
| 6,424,309 | B1 * | 7/2002 | Johnston | H01Q 13/10 343/795 |
| 8,283,619 | B2 * | 10/2012 | Novack | H01Q 21/061 250/208.2 |
| 9,300,053 | B2 * | 3/2016 | Wunsch | F41H 5/023 |
| 2001/0050640 | A1 * | 12/2001 | Apostolos | H01Q 5/357 343/795 |

(Continued)

OTHER PUBLICATIONS

Iwasaki, Hisao, "A Circularly Polarized Small-Size Microstrip Antenna with a Cross Slot," IEEE Transactions on Antennas and Propagation, vol. 44, No. 10, Oct. 1996, 3 pages.

(Continued)

*Primary Examiner* — Graham P Smith
(74) *Attorney, Agent, or Firm* — Barta, Jones & Foley, PLLC

(57) ABSTRACT

Aspects of the disclosure are directed to an antenna assembly having a first conductive element having a bowtie shape, the first conductive element on a dielectric material at a first layer; a feed point within the bowtie; a second conductive element as a feed line, at a second layer, wherein the second conductive element is electrically coupled to the first conductive element at least at the feed point, independently of direct electrical contact between the first conductive element and the second conductive element; and a ground plane. In some implementations, the second conductive element has no direct electrical contact with the first conductive element, and electrical coupling of the conductive elements comprises electric fields within the dielectric. This reduces the risk of electrical performance degradation caused by mechanical damage at the feed point, such as when the antenna assembly is installed to conform to a non-planar surface.

20 Claims, 10 Drawing Sheets

(56) References Cited

U.S. PATENT DOCUMENTS

| | | | | |
|---|---|---|---|---|
| 2005/0156776 | A1* | 7/2005 | Waite | G01V 3/12 342/22 |
| 2009/0102705 | A1* | 4/2009 | Obermeyer | G01S 13/9029 343/705 |
| 2011/0277805 | A1* | 11/2011 | Novack | H02S 99/00 136/243 |
| 2015/0318618 | A1* | 11/2015 | Chen | H01P 7/082 343/750 |
| 2016/0218423 | A1* | 7/2016 | Roulston | H01Q 13/18 |
| 2016/0336657 | A1* | 11/2016 | Wunsch | H01Q 9/28 |
| 2018/0034137 | A1* | 2/2018 | LeBaron | G06K 19/067 |
| 2018/0226726 | A1* | 8/2018 | Hsu | H01Q 19/108 |
| 2019/0058232 | A1* | 2/2019 | Fruehling | H01P 7/065 |
| 2021/0288408 | A1* | 9/2021 | Rogers | H01Q 1/38 |

OTHER PUBLICATIONS

Pozar, et al., "A Rigorous Analysis of a Microstripline Fed Patch Antenna," IEEE Transactions on Antennas and Propagation, vol. AP-35, No. 12, Dec. 1987, 8 pages.

Pozar, et al., "Increasing the Bandwidth of a Microstrip Antenna by Proximity Coupling," Department of Electrical and Computer Engineering, University of Massachusetts, Mar. 3, 1987, 2 pages.

Cook, et al., "Multilayer Inkjet Printing of Millimeter-Wave Proximity-Fed Patch Arrays on Flexible Substrates," IEEE Antennas and Wireless Propagation Letters, vol. 12, 2013, 4 pages.

Davidovitz, et al., "Rigorous Analysis of a Circular Patch Antenna Excited by a Microstrip Transmission Line," IEEE Transactions on Antennas and Propagation, vol. 37, No. 8, Aug. 1989, 10 pages.

* cited by examiner

500a

500b

ELECTRICALLY COUPLED BOWTIE ANTENNA

BACKGROUND

Certain antenna applications, for example, some unmanned aerial vehicles (UAVs), present significant challenges for radio frequency (RF) communication systems, particularly for antennas that need to provide communication or telemetry information. Smaller form factors present fewer and/or smaller flat surfaces for antenna installation, and increases the importance of avoiding drag-inducing protrusions. Due to growing demand for smaller aircraft, the need for light weight, conformal antennas has escalated.

Thus, small aircraft need light weight, low profile antennas for low aerodynamic drag, to improve efficiency and, in some applications, provide low visibility (e.g., radar cross section, or RCS). Unfortunately, common monopole and dipole antennas (e.g., whip, blade, Yagi, etc.) often protrude off the surface of an aircraft, which increases aerodynamic drag, and are known to increase the RCS. Furthermore, such common antennas often undergo electrical performance changes when installed near conductive surfaces, such as an aircraft skin.

SUMMARY

The disclosed examples are described in detail below with reference to the accompanying drawing figures listed below. The following summary is provided to illustrate implementations disclosed herein. It is not meant, however, to limit all examples to any particular configuration or sequence of operations.

Some aspects and implementations disclosed herein are directed to an antenna assembly having a first conductive element having a bowtie shape, the first conductive element on a dielectric material at a first layer; a feed point within the bowtie shape; a second conductive element configured as a feed line, the second conductive element on the dielectric material at a second layer, wherein the second conductive element is electrically coupled to the first conductive element at least at the feed point, independently of direct electrical contact between the first conductive element and the second conductive element; and a ground plane. In some implementations, the second conductive element has no direct electrical contact with the first conductive element, such that electrical coupling of the conductive elements comprises electric fields within the dielectric material. This reduces the risk of electrical performance degradation caused by mechanical damage at the feed point, such as when the antenna assembly is installed in a conformal application on a non-planar surface.

The features, functions, and advantages that have been discussed are achieved independently in various implementations or are to be combined in yet other implementations, further details of which are seen with reference to the following description and drawings.

BRIEF DESCRIPTION OF THE DRAWINGS

The disclosed examples are described in detail below with reference to the accompanying drawing figures listed below.

Corresponding reference characters indicate corresponding parts throughout the drawings.

DETAILED DESCRIPTION

The various implementations will be described in detail with reference to the accompanying drawings. Wherever possible, the same reference numbers will be used throughout the drawings to refer to the same or like parts. References made throughout this disclosure relating to specific implementations and implementations are provided solely for illustrative purposes but, unless indicated to the contrary, are not meant to limit all implementations.

The foregoing summary, as well as the following detailed description of certain implementations will be better understood when read in conjunction with the appended drawings. As used herein, an element or step recited in the singular and preceded by the word "a" or "an" should be understood as not necessarily excluding the plural of the elements or steps. Further, references to "one implementation" are not intended to be interpreted as excluding the existence of additional implementations that also incorporate the recited features. Moreover, unless explicitly stated to the contrary, implementations "comprising" or "having" an element or a plurality of elements having a particular property could include additional elements not having that property.

Figure 1:
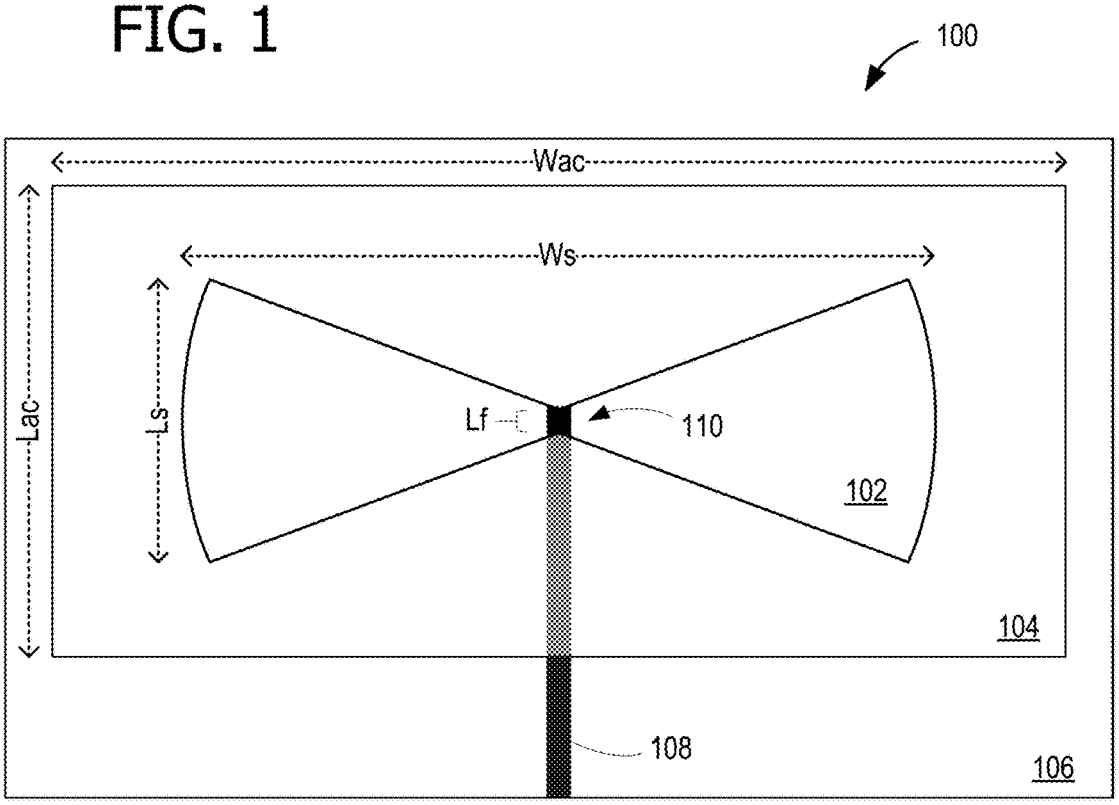
FIG. 1 illustrates a top view of an exemplary electrically coupled bowtie antenna assembly 100.
Figure 6:
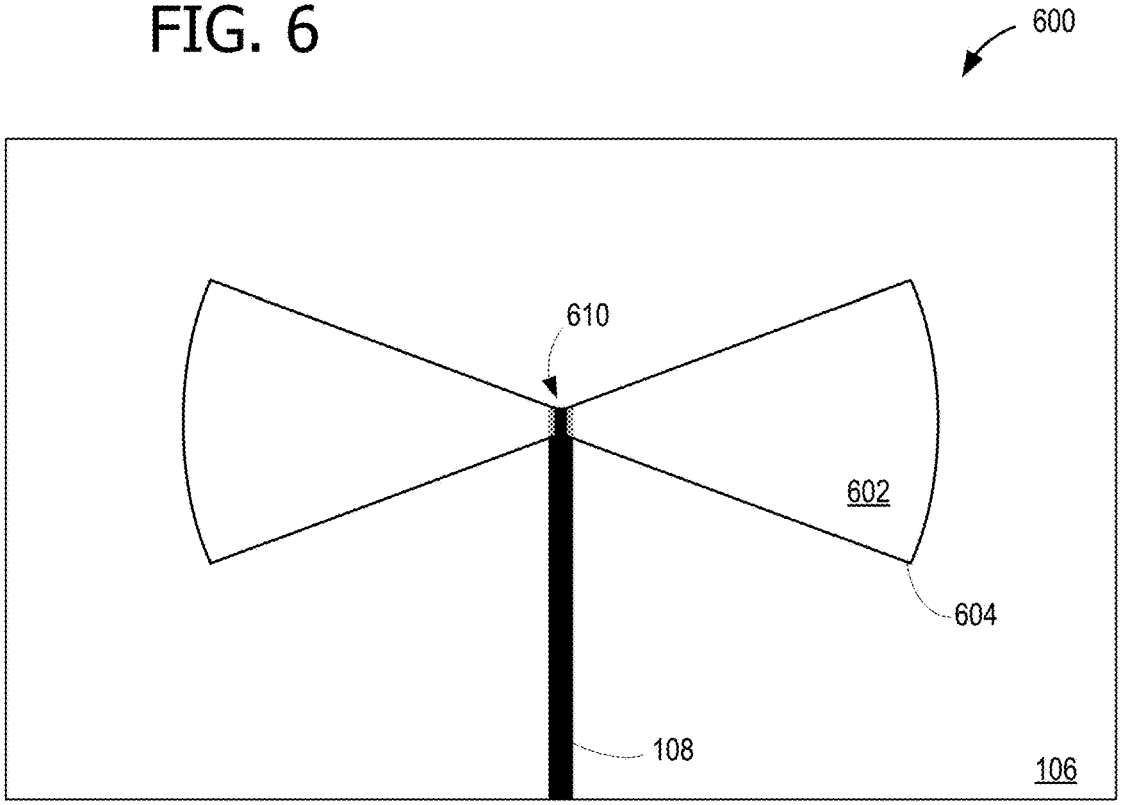
FIG. 6 illustrates a top view of an exemplary complementary electrically coupled bowtie antenna assembly 600 that is based upon the antenna assembly 100 of FIG. 1.

The antenna assembly (e.g., electrically coupled bowtie antenna assembly) 100, described in relation to FIG. 1, and the antenna assembly (e.g., complementary electrically coupled bowtie antenna assembly) 600, described in relation to FIG. 6, include a proximity coupled bowtie antenna (either a bowtie shaped gap 102 or a bowtie shaped opening within a first conductive element 104) or a bowtie shaped conductive element, such as conductive element 602), a feed line (e.g., a second conductive element 108), and a ground plane 306 on a dielectric material 106. Antenna assemblies 100 and 600 are useful, for example in radio frequency (RF) communication systems. In some implementations, the second conductive element 108 (feed line) has no direct electrical contact with the first conductive element 104 having the bowtie shaped gap 102 (see FIG. 1) or with the conductive element 602 (see FIG. 6). Rather, electrical coupling relies on electric fields within the dielectric material 106. This reduces the risk of electrical performance degradation caused by mechanical damage (e.g., sheared metallic interconnects), that occurs in a bent conformal application on a non-planar surface when subjected to vibrations, temperature fluctuations, and other mechanical stresses that are common in aircraft operational environments.

Additionally, the ground plane 306 minimizes antenna performance changes for installed applications, for example, when placed on a conductive surface such as a wing, a fuselage, a tail fin, or another part of an aircraft. In some implementations, the dielectric material 106 is flexible to permit conforming to a non-planar surface when installed, while still maintaining a low profile. Some implementations are manufactured using subtractive (e.g., laser etch, milling, wet etching) or additive (e.g., printing, film deposition) methods. Implementations are advantageously employed for air-to-air communications for both manned and unmanned vehicles, such as unmanned aerial vehicles (UAVs); air-to-ground communications; internet of things (IoT) on aircraft (e.g., structural health monitoring), and IoT in other settings (e.g., factories, electromagnetic energy monitoring, and diagnostic testing of aircraft).

Figure 2:
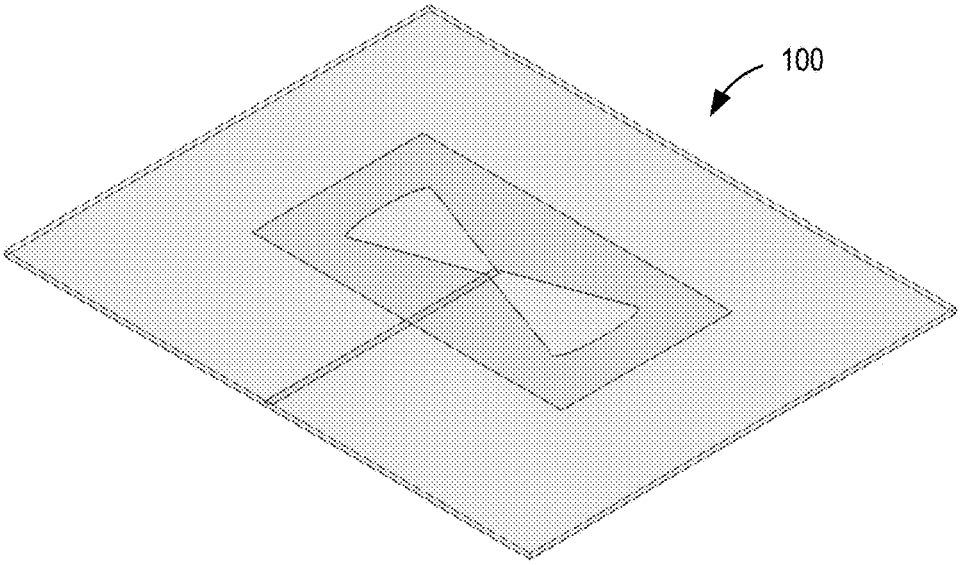
FIG. 2 illustrates perspective view of the antenna assembly 100 of FIG. 1.
Figure 3A:
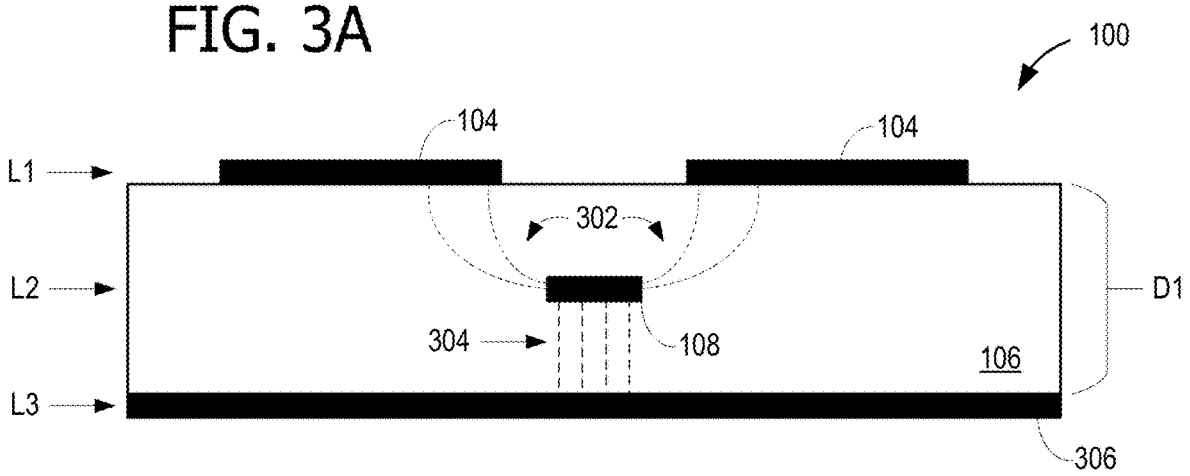
FIG. 3A illustrates a side view of the antenna assembly 100 of FIG. 1.

FIG. 1 illustrates a top view of an exemplary implementation of the antenna assembly 100; FIG. 2 illustrates a perspective view; and FIG. 3A illustrates a side view. FIGS. 1-3A should be viewed together. The antenna assembly 100 comprises the first conductive element 104 having a bowtie shape defined by the bowtie shaped gap 102 within the first conductive element 104. A feed point 110 is within the bowtie shape, for example at the center of the bowtie shaped gap 102, although the feed point 110 may be off-center in some implementations. For simplicity of illustration, the first conductive element 104 is not filled in, and the lightly shaded portion of the second conductive element 108 is a hidden surface, underneath the first conductive element 104.

The first conductive element 104 is on the dielectric material 106 at a first layer L1. The second conductive element 108 is configured as a feed line and is located on the dielectric material at a second layer L2. The second layer L2 is not in the same plane as the first layer L1 (e.g., the second layer L2 and the first layer L1 are not co-located). That is, the second layer L2 is below the first layer L1. In some implementations, the second conductive element 108 is configured as a microstrip feed line. The second conductive element 108 is electrically coupled to the first conductive element 104 at least at the feed point 110, independently of direct electrical contact between the first conductive element 104 and the second conductive element 108. The first conductive element 104 and the second conductive element 108 together form an electrically coupled bowtie antenna (i.e., a proximity coupled bowtie antenna).

In some implementations, the second conductive element 108 has no direct electrical contact with the first conductive element 104, such that electrical coupling of the second conductive element 108 with the first conductive element 104 comprises electric fields 302 within the dielectric material 106 between the first conductive element 104 and the second conductive element 108, thereby reducing a risk of electrical performance degradation caused by mechanical damage at the feed point 110. The antenna assembly 100 further comprises a ground plane 306 on the dielectric material 106 at a third layer L3 opposite (at least a portion of the dielectric material 106) the first layer L1 and the second layer L2.

The dimensions of the antenna assembly 100 are determined in a manner that maximizes signal propagation and bandwidth at the desired operating frequency band. A distance of approximately one quarter of a wavelength (214), measured within the dielectric material 106, provides constructive interference with electromagnetic fields that radiate from the first conductive element 104 in the direction of the ground plane 306. A one-way distance of one quarter of a wavelength results in a round-trip distance of half of a wavelength. This provides a phase shift of 180°. However, the reflection from the ground plane 306 provides another 180° phase shift, which returns the reflected wave to being in-phase with electromagnetic fields that radiate from the first conductive element 104 in the direction away from the ground plane 306. Thus, in some implementations, a distance D1 between the first layer L1 and the third layer L3 is between three sixteenths (3/16) and five sixteenths (5/16) of a wavelength at an operating frequency of the antenna assembly 100. Equation 1 shows the relationship between operating frequency, $f$, of the antenna assembly 100 and the wavelength, $\lambda$, within the dielectric material 106:

$$\lambda = c/(f\sqrt{\varepsilon_r}) \qquad \text{Equation 1}$$

Where c is the speed of light in free-space and $\varepsilon_r$ is the relative permittivity of the dielectric material 106.

In some implementations, the dielectric material 106 has a relative permittivity of between 3.0 and 4.0. For implementations in which the dielectric material 106 has a relative permittivity of 3.4, the wavelength, $\lambda$, will be approximately 54% of the wavelength in air.

In some implementations, an operating frequency of the antenna assembly 100 is in the X-band (is an X-band frequency). Some implementations operate at different frequencies, such as those in one of the bands HF, VHF, UHF, L, S, C, and other bands. Global Positioning System (GPS) signals, for example, are in the L-band because L-band waves penetrate clouds, fog, rain, storms, and vegetation. L band refers to the operating frequency range of 1-2 GHz in the radio spectrum. The wavelength range of L band in air is 15-30 centimeters (cm). Common civil aircraft communications use the VHF band.

Equations 2 through 5 show the relationships between the operating frequency of the antenna assembly 100 and the dimensions of the antenna assembly 100:

$$Wac \approx \lambda/2 \qquad \text{Equation 2}$$

$$Ws \approx \lambda/3 \qquad \text{Equation 3}$$

$$Ls \approx \lambda/8 \qquad \text{Equation 4}$$

$$Ls < Lac \leq Wac \qquad \text{Equation 5}$$

In some implementations, the first conductive element 104 has a width, Wac (width of the antenna conductive element), of a half of a wavelength at an operating frequency of the antenna assembly 100. In some implementations, the bowtie shape (of the bowtie shaped gap 102) has a width, Ws (width of the slot, or gap), of a third of a wavelength at an operating frequency of the antenna assembly 100. In some implementations, the bowtie shape (of the bowtie shaped gap 102) has a length, Ls (length of the slot, or gap), of an eighth of a wavelength at an operating frequency of the antenna assembly 100. In some implementations, the first conductive element 104 has a length, Lac (length of the antenna conductive element) that is no greater than the width of the first conductive element. However, the length, Lac, of the first conductive element 104 is greater than the length, Ls, of the bowtie shaped gap 102. The feed point 110 has a minimum gap length of Lf.

In some implementations, the first conductive element 104 has a thickness of at least 0.7 thousandths of an inch (mil). In some implementations, the first conductive element 104 comprises copper. In some implementations, the second conductive element 108 has a thickness of at least 0.7 mil. In some implementations, the second conductive element 108 comprises copper. In some implementations, the ground plane comprises copper. In some implementations, other or additional conductive materials are used. The second conductive element 108 is configured as a feed line to minimize power loss and simplify planar arraying. The ground plane 306 reduces changes in the electrical behavior of antenna assembly 100 due to installation or nearby conductive surfaces.

In some implementations, the dielectric material 106 utilizes thin RF dielectrics for conformal applications. In such implementations, the antenna assembly 100 is flexible, thereby permitting the antenna assembly 100 to conform to a non-planar surface. The prospect of being installed in a bent conformal configuration in an operational environment that is subject to vibrations, temperature fluctuations, and other mechanical stresses, highlights the importance of the proximity coupling of the first conductive element 104 with the second conductive element 108. The lack of a direct electrical contact between the first conductive element 104 the second conductive element 108 has a clear benefit: If there is no direct electrical contact, then it cannot break, tear, or otherwise disconnect despite the mechanical stresses on antenna assembly 100.

Figure 3B:
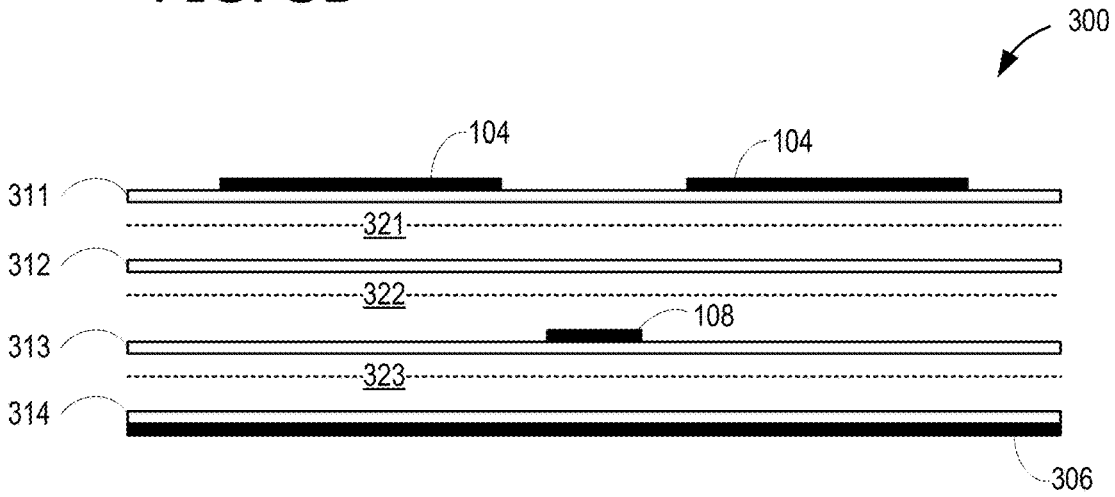
FIG. 3B illustrates an expanded view 300 of dielectric layers 311-314 of the antenna assembly 100 of FIG. 1.

FIG. 3B illustrates an expanded view 300 of dielectric layers 311, 312, 313, and 314 of an implementation of the antenna assembly 100 of FIG. 1. As illustrated in FIG. 3B, the dielectric material 106 comprises a stacked set of the dielectric layers 311-314, joined with intervening epoxy layers 321, 322, and 323. In some implementations, the dielectric layers 311-314 have a thickness of approximately 10 mil, and the epoxy layers 321-323 have a thickness of approximately 1 mil. In some implementations, a different number of stacked dielectric layers are used. With some materials, thinner dielectric layers are more flexible.

Figure 8:
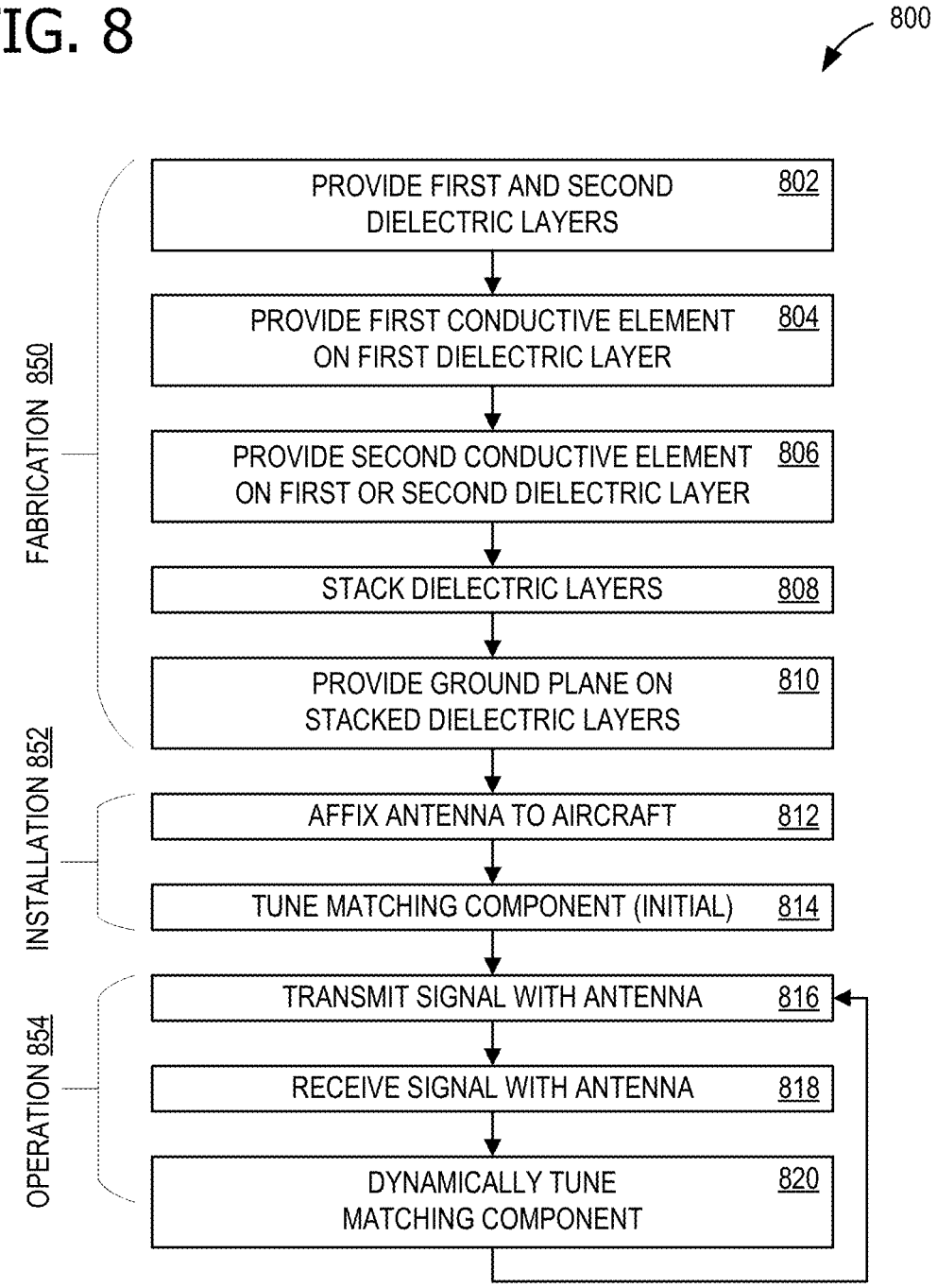
FIG. 8 is a flow chart illustrating a process 800 for manufacturing, installing, and using the antenna assembly 100 of FIG. 1 or the antenna assembly 600 of FIG. 6.

Some implementations of the antenna assembly 100 are manufactured according to process 800 illustrated in FIG. 8. For example, the dielectric layers 311-314 starts out as dielectric slabs with a conductive material on both sides. A first dielectric layer 311 is etched to form the first conductive element 104 having the bowtie shaped gap 102 shown in FIG. 1; an optional fourth dielectric layer 312 has all of the conductive material removed; a second dielectric layer 313 is etched to form the second conductive element 108; and third dielectric layer 314 is not etched on the bottom, so that the ground plane 306 remains intact. In this configuration, optional fourth dielectric layer 312 acts as a spacer layer to increase the distance between the first conductive element 104 and the second conductive element 108. It should be understood that variations in the placement and thickness of spacer layers can be used to tailor the performance of the antenna assembly 100.

In another implementation, the dielectric layers 311-314 start out as bare dielectric slabs. Conductive material is deposited on a first dielectric layer 311 to form the first conductive element 104 having the bowtie shaped gap 102, and conductive material is deposited on the second dielectric layer 313 to form the second conductive element 108. Other variations are possible, such as the second conductive element 108 being deposited on dielectric layer 312, or a single dielectric layer having the first conductive element 104 deposited on one side and the second conductive element 108 being deposited on the opposite side.

Figure 3C:
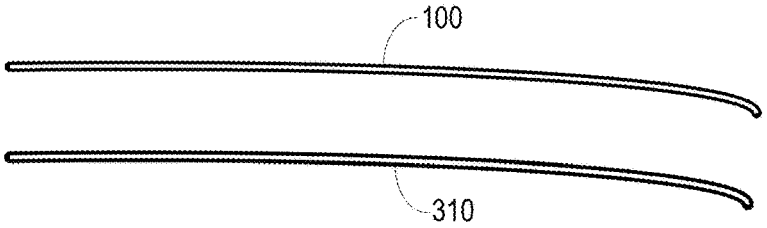
FIG. 3C illustrates a side view of the antenna assembly 100 of FIG. 1 in a bent shape, for example in an installed conformal configuration.
Figure 10:
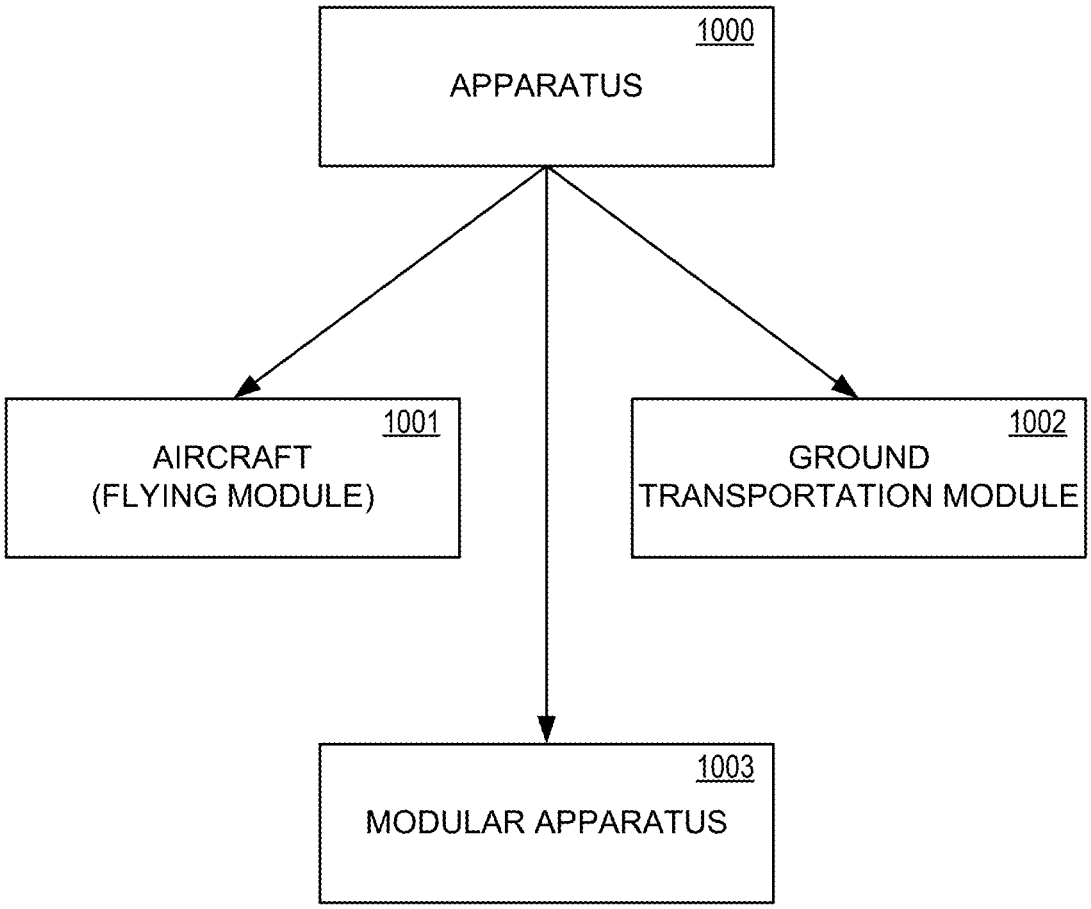
FIG. 10 is a block diagram of an apparatus 1100 that advantageously employs the antenna assembly 100 of FIG. 1 or the antenna assembly 600 of FIG. 6.

FIG. 3C illustrates a side view of the antenna assembly 100 of FIG. 1 in a bent, conformal configuration, for example in an installed configuration on a non-planar surface 310 (e.g., the non-planar surface 310 of the aircraft 1001 of FIG. 10). In some implementations however, the antenna assembly 100 is installed on a planar surface that does not require bending of the antenna assembly 100.

Figure 4:
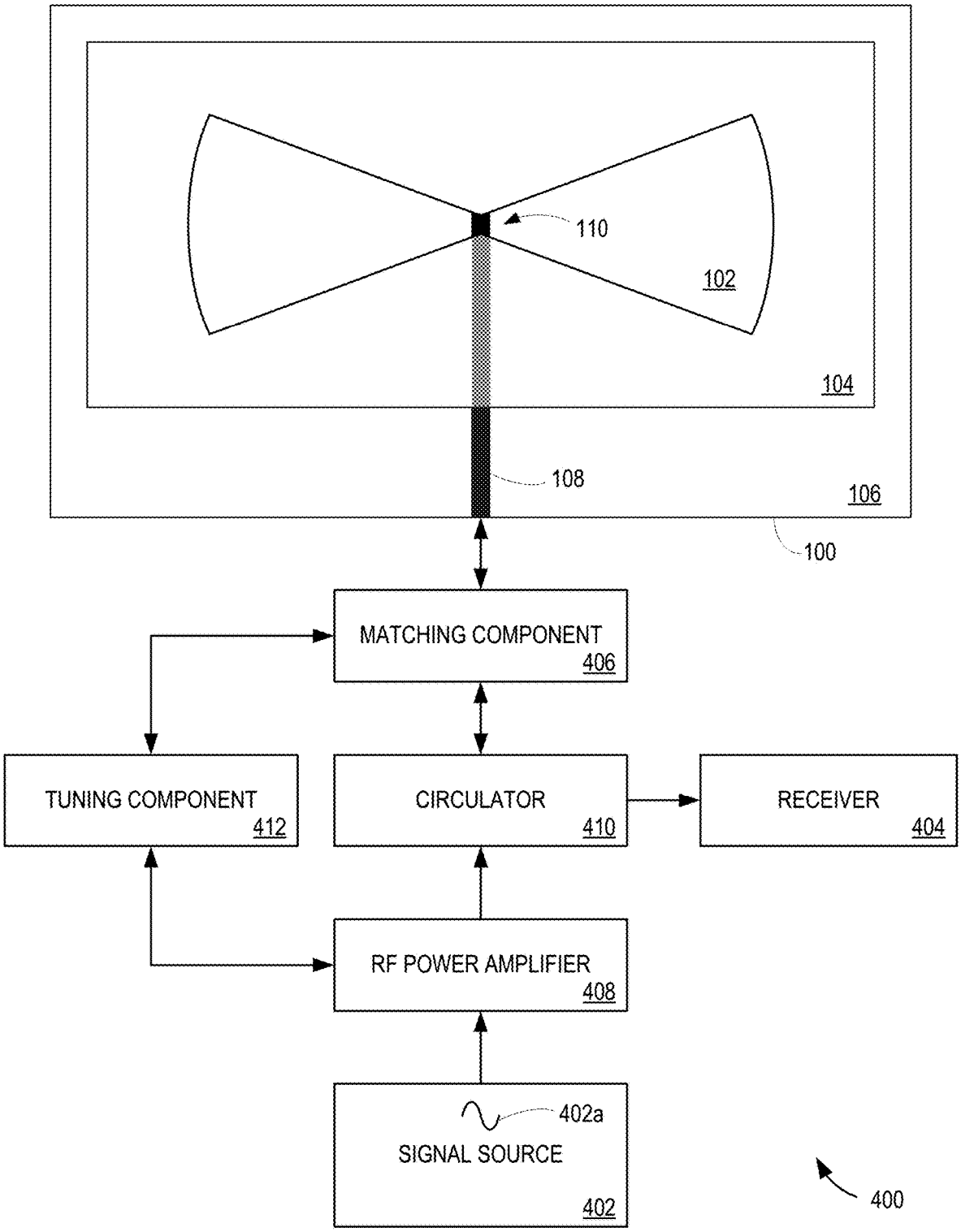
FIG. 4 illustrates an exemplary transmitting arrangement 400 that includes the antenna assembly 100 of FIG. 1.

FIG. 4 illustrates an exemplary transmitting arrangement 400 that includes the antenna assembly 100 of FIG. 1. In some implementations, however, the transmitting arrangement 400 uses the antenna assembly 600 of FIG. 6 in place of the antenna assembly 100. The transmitting arrangement 400 includes a signal source 402 and a receiver 404 coupled to the antenna assembly 100, specifically coupled to the second conductive element 108. The signal source 402 is operable to transmitting a signal 402*a* using the antenna assembly 100 (or 600). The receiver 404 is operable to receive an incoming signal using the antenna assembly 100.

In some implementations, a matching component 406 is coupled to the second conductive element 108. The matching component 406 is disposed between the signal source 402 and the antenna assembly 100, specifically, opposite the feed point 110 along the second conductive element 108. This permits the matching component 406 to be used for tuning the antenna assembly 100, for example for impedance matching. In some implementations, a power amplifier 408 is disposed between the signal source 402 and the antenna assembly 100. In some implementations, the matching component 406 is disposed between the power amplifier 408 and the second conductive element 108. In some implementations, a circulator 410 routes the signal 402*a* from the signal source 402 to the antenna assembly 100 and incoming signals from the antenna assembly 100 to the receiver 404. In some implementations, a tuning component 412 is coupled to the matching component 406 for dynamically tuning the matching component 406. In some implementations, the tuning component 412 is coupled to both the matching component 406 and the power amplifier 408, and is able to sense a mismatch, for example, by sensing reflections from the antenna assembly 100.

Figure 5A:
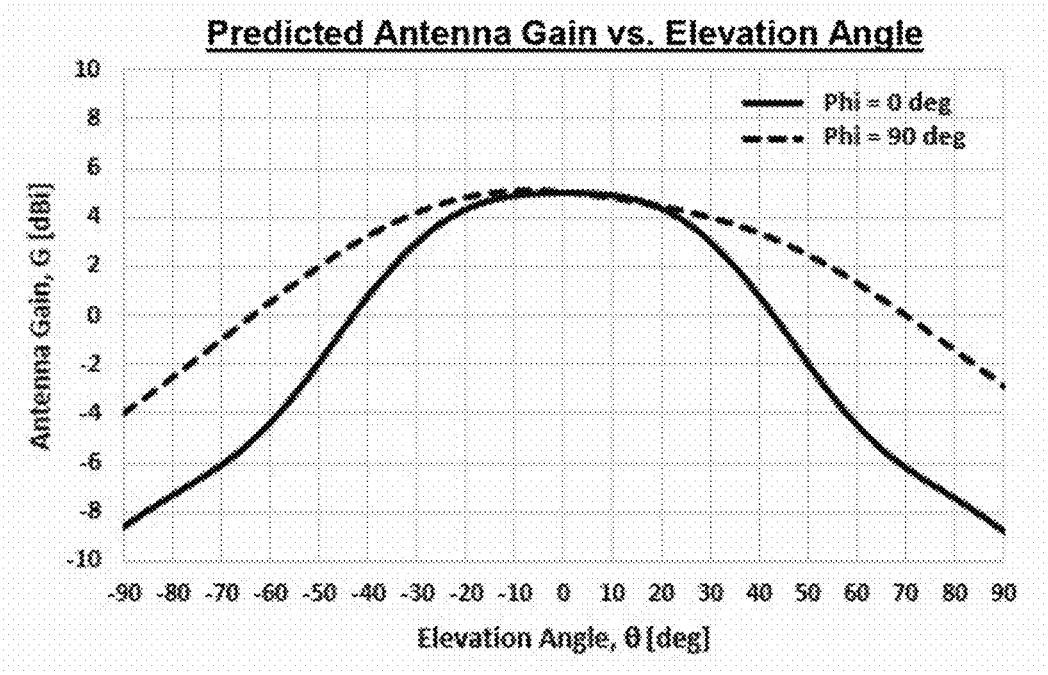
FIG. 5A illustrates an exemplary first antenna performance plot (a gain plot 500*a*) for an implementation of the antenna assembly 100 of FIG. 1.
Figure 5B:
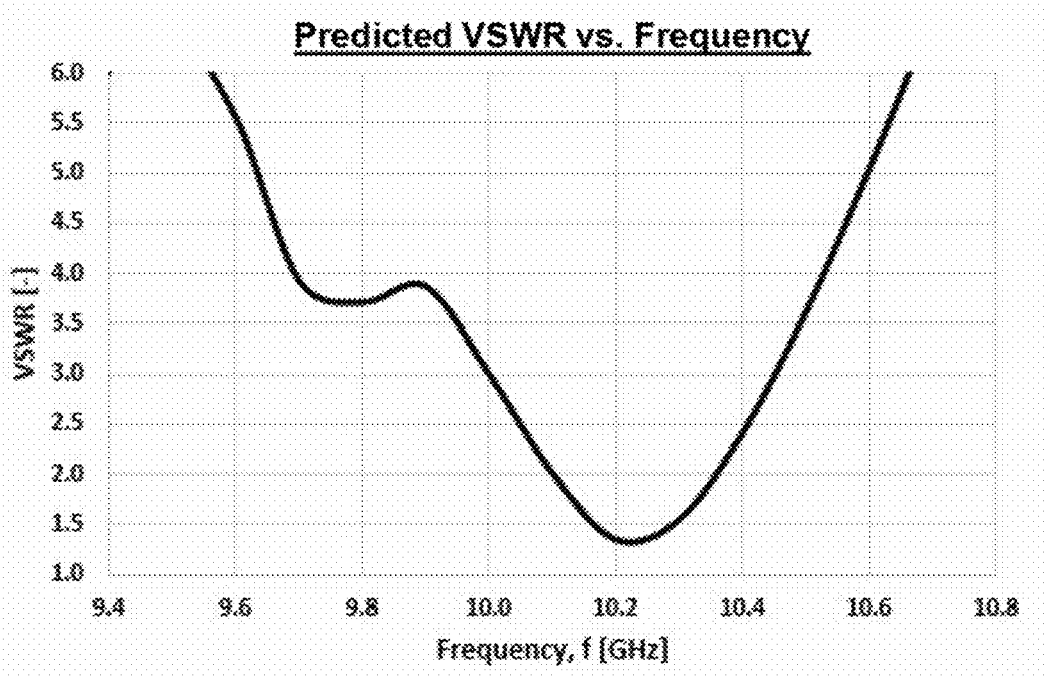
FIG. 5B illustrates an exemplary second antenna performance plot (a voltage standing wave ratio (VSWR) plot 500*b*) for an implementation of the antenna assembly 100 of FIG. 1.

FIG. 5A illustrates an exemplary first antenna performance plot, a gain plot 500*a*, for an implementation of the antenna assembly 100 of FIG. 1, and FIG. 5B illustrates an exemplary second antenna performance plot, a voltage standing wave ratio (VSWR) plot 500*b*, for the same implementation. The implementation was designed to operate near 10 GHz.

The gain plot 500*a* shows the antenna gain as a function of elevation angle in orthogonal cut planes, $\Phi=0°$ and $\Phi=90°$. The illustrated gain is 5.1 dBi (decibels relative to an isotropic radiator) with a 3 dB beamwidth of 68 degrees for the implementation the antenna assembly 100 operating at approximately 10 GHz (in the X-band). VSWR plot 500*b* indicates a resonant frequency of 10.35 GHz and a bandwidth of approximately 450 MHz using a 3:1 VSWR as the definition of the bandwidth endpoints.

Figure 7:
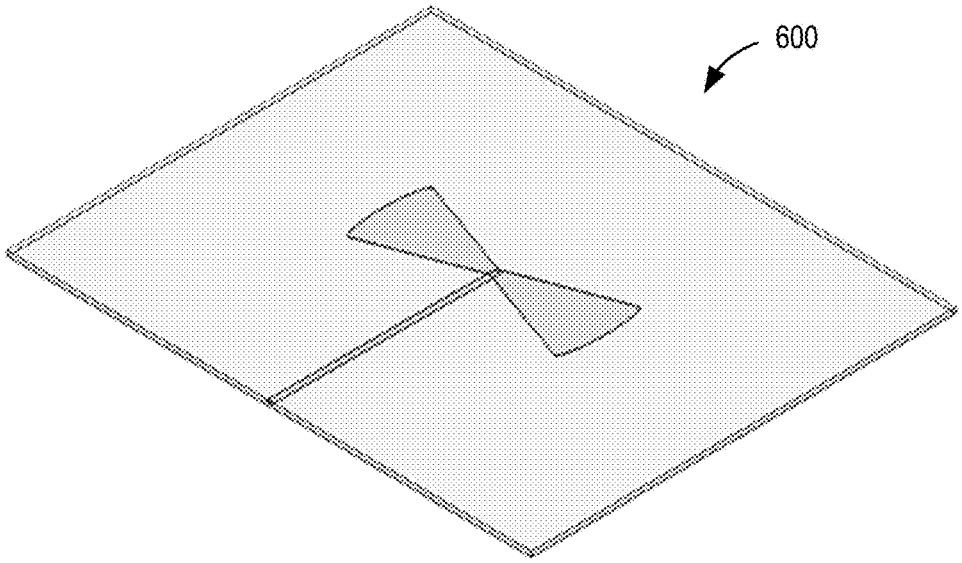
FIG. 7 illustrates a perspective view of the antenna assembly 600 of FIG. 6.

FIG. 6 illustrates a top view of an exemplary antenna assembly (e.g., a complementary electrically coupled bowtie antenna assembly) 600 that is based upon the antenna assembly 100 of FIG. 1, and FIG. 7 illustrates a perspective view. Based upon Babinet's principle, which states that the diffraction pattern from an opaque body is identical to that from a hole of the same size and shape (except for the forward beam intensity), similar radiation performance is expected from a bowtie antenna constructed by inverting the gap and conductive material of first conductive element 104 of antenna assembly 100. That is, the bowtie shaped gap 102 is replaced with a conductive material (the conductive element 602) and the remainder of the first conductive element 104 is removed. For simplicity of illustration, the conductive element 602 is not filled in, and the lightly shaded portions of the second conductive element 108 are hidden surfaces, underneath the conductive element 602. The bowtie shape is defined by an outer edge 604 of the conductive element 602.

The resulting structure of the antenna assembly 600 has the conductive element 602 with the outer edge 604 in a bowtie shape, the dielectric material 106, the second conductive element 108, and the ground plane 306 (not visible). The second conductive element 108 electrically couples with the conductive element 602 at a feed point 610. The feed point 610 has a gap between opposing sides of the conductive element 602. The side view of the antenna assembly 600 is similar to that of the antenna assembly 100, although with the differences noted above for the position of the conductive material.

In some implementations, the bowtie shape of the conductive element is filled in with the conductive element 602 (that is, the conductive element 602 is a solid sheet with only a gap across the feed point 610); however, with a filled-in shape, this is not necessary. Currents on the conductive element 602 tend to be concentrated on the outer edge 604, permitting removal of conductive material from the center portion of the bowtie shape. This, in some implementations, the conductive element 602 forms only a trace along the outer edge 604. The other applications and uses, and theory of operation described for the antenna assembly 100 also apply to the antenna assembly 600, for example, use within the transmitting arrangement 400 of FIG. 4 or within the process 800 of FIG. 8.

FIG. 8 is a flow chart illustrating a process 800 for manufacturing, installing, and using the antenna assembly 100 of FIG. 1 or the antenna assembly 600 of FIG. 6. That is, process 800 includes a method of making the antenna assembly 100 or the antenna assembly 600. The antenna assembly 100 and the antenna assembly 600 is manufactured using subtractive (e.g., laser etch, milling, wet etching) or additive (e.g., printing, film deposition) methods. In some implementations, operation 802 includes providing the first dielectric layer 311 and the second dielectric layer 313. Operation 804 includes providing a first conductive element (e.g., the first conductive element 104 or the conductive element 602) on the first dielectric layer 311, the first conductive element 104 or the conductive element 602 having a bowtie shape, the bowtie shape having the feed point 110 or the feed point 610. Operation 806 includes providing a second conductive element 108 on the first or the second dielectric layer 311 or 313, the second conductive element 108 configured as a feed line.

Operation 808 includes stacking the first and the second dielectric layers 311 and 313 to couple the second conductive element 108 to the first conductive element 104 or the conductive element 602 at least at the feed point 110 or the feed point 610 of the bowtie shape, thereby forming an electrically coupled bowtie antenna, wherein the coupling is independent of direct electrical contact between the first conductive element 104 or the conductive element 602 and the second conductive element 108. Operation 810 includes providing a ground plane 306 for the first and the second dielectric layers 311 and 313 that are stacked, the ground plane 306 is disposed below the first and the second dielectric layers 311 and 313 that are stacked opposite the first conductive element 104 or the conductive element 602 and the second conductive element 108. Together, operations 802-810 form a fabrication operation 850.

Operation 812 includes affixing the antenna assembly 100 or 600 to a non-planar surface 310 on an exterior of an aircraft 1001 such that the antenna assembly 100 or 600 conforms to the non-planar surface 310. Operation 814 includes, after affixing the antenna assembly 100 or 600 to the aircraft 1001, tuning the antenna assembly 100 or 600 using a matching component 406 coupled to the second conductive element 108. Together, operations 812 and 814 form an installation operation 852.

Operation 816 includes, after affixing the antenna assembly 100 or 600 to the aircraft 1001, during operation of the aircraft 1001, transmitting a signal 402*a* using the antenna assembly 100 or 600. Operation 818 includes, after affixing the antenna assembly 100 or 600 to the aircraft 1001, during operation of the aircraft 1001, receiving a signal using the antenna assembly 100 or 600. Operation 820 includes, after affixing the antenna assembly 100 or 600 to the aircraft 1001, dynamically tuning the antenna assembly 100 or 600 using a matching component 406 coupled to the second conductive element 108.

Figure 9:
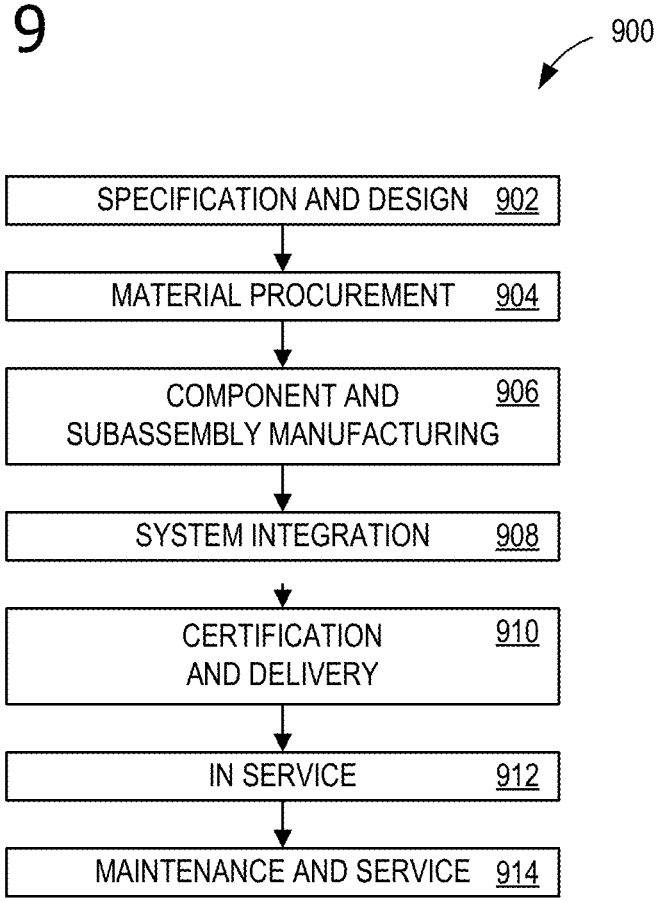
FIG. 9 is a block diagram of an apparatus of manufacturing and service method 900 that advantageously employs the antenna assembly 100 of FIG. 1 or the antenna assembly 600 of FIG. 6.
Figure 11:
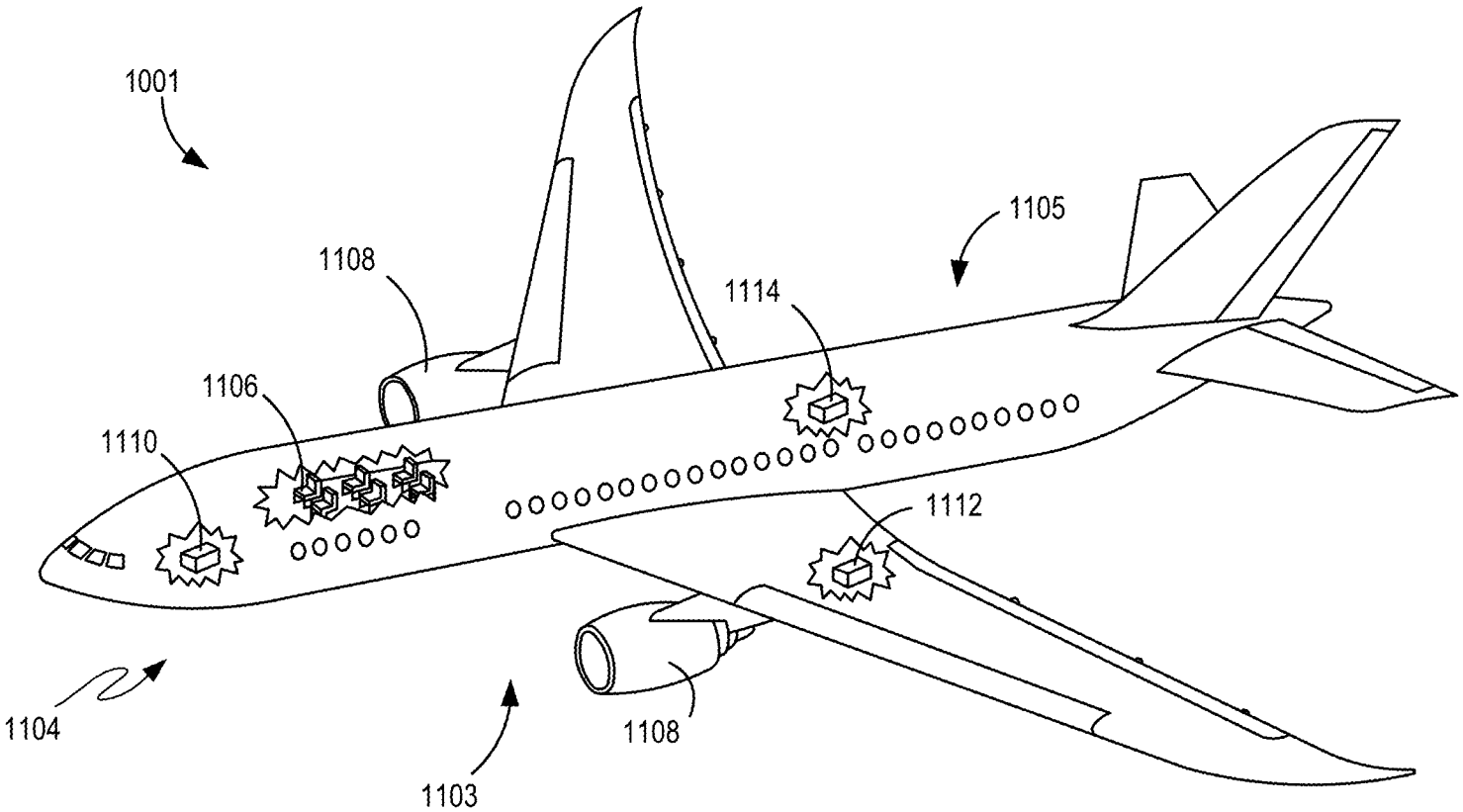
FIG. 11 is a schematic perspective view of a particular aircraft 1001 of FIG. 10.

Some implementations of the antenna assembly 100 of FIG. 1 and antenna assembly 600 of FIG. 6 are used in manufacturing and service applications as shown and described in relation to FIGS. 9-11. Thus, implementations of the disclosure are described in the context of an apparatus of manufacturing and service method 900 shown in FIG. 9 and apparatus 1000 shown in FIG. 10. In FIG. 9, a diagram illustrating an apparatus manufacturing and service method is depicted in accordance with an implementation. In one implementation, during pre-production, the apparatus manufacturing and service method 900 includes specification and design 902 of the apparatus 1000 in FIG. 10 and material procurement 904. During production, component and subassembly manufacturing 906 and system integration 908 of the apparatus 1000 in FIG. 10 takes place. Thereafter, the apparatus 1000 in FIG. 10 goes through certification and delivery 910 in order to be placed in service 912. While in service by a customer, the apparatus 1000 in FIG. 10 is scheduled for routine maintenance and service 914, which, in one implementation, includes modification, reconfiguration, refurbishment, and other maintenance or service described herein.

In one implementation, each of the processes of the apparatus manufacturing and service method 900 are performed or carried out by a system integrator, a third party, and/or an operator. In these implementations, the operator is a customer. For the purposes of this description, a system integrator includes any number of apparatus manufacturers and major-system subcontractors; a third party includes any number of venders, subcontractors, and suppliers; and in one implementation, an operator is an owner of an apparatus or fleet of the apparatus, an administrator responsible for the apparatus or fleet of the apparatus, a user operating the apparatus, a leasing company, a military entity, a service organization, or the like.

With reference now to FIG. 10, the apparatus 1000 is provided. As shown in FIG. 10, an example of the apparatus 1000 is an aircraft 1001 (flying module), such as an aerospace vehicle, aircraft, air cargo, flying car, and the like. In some implementations, the aircraft 1001 is an orbital or space-based platform. As also shown in FIG. 10, a further example of the apparatus 1000 is a ground transportation module 1002, such as an automobile, a truck, heavy equipment, construction equipment, a boat, a ship, a submarine and the like. A further example of the apparatus 1000 shown in FIG. 10 is a modular apparatus 1003 that comprises at least one or more of the following modules: an air module, a payload module and a ground module. The air module provides air lift or flying capability. The payload module provides capability of transporting objects such as cargo or live objects (people, animals, etc.). The ground module provides the capability of ground mobility. The disclosed solution herein is applied to each of the modules separately or in groups such as air and payload modules, or payload and ground, etc. or all modules.

With reference now to FIG. 11, a more specific diagram of the aircraft 1001 is depicted in which an implementation of the disclosure is advantageously employed. In this example, the aircraft 1001 is an aircraft produced by the apparatus manufacturing and service method 900 in FIG. 9 and includes an airframe 1103 with a plurality of systems 1004, an exterior 1105, and an interior 1106. Implementations of the plurality of systems 1104 include one or more of a propulsion system 1108, an electrical system 1110, a hydraulic system 1112, and an environmental system 1114. However, other systems are also candidates for inclusion. Although an aerospace example is shown, different advantageous implementations are applied to other industries, such as the automotive industry, etc.

Figure 12:
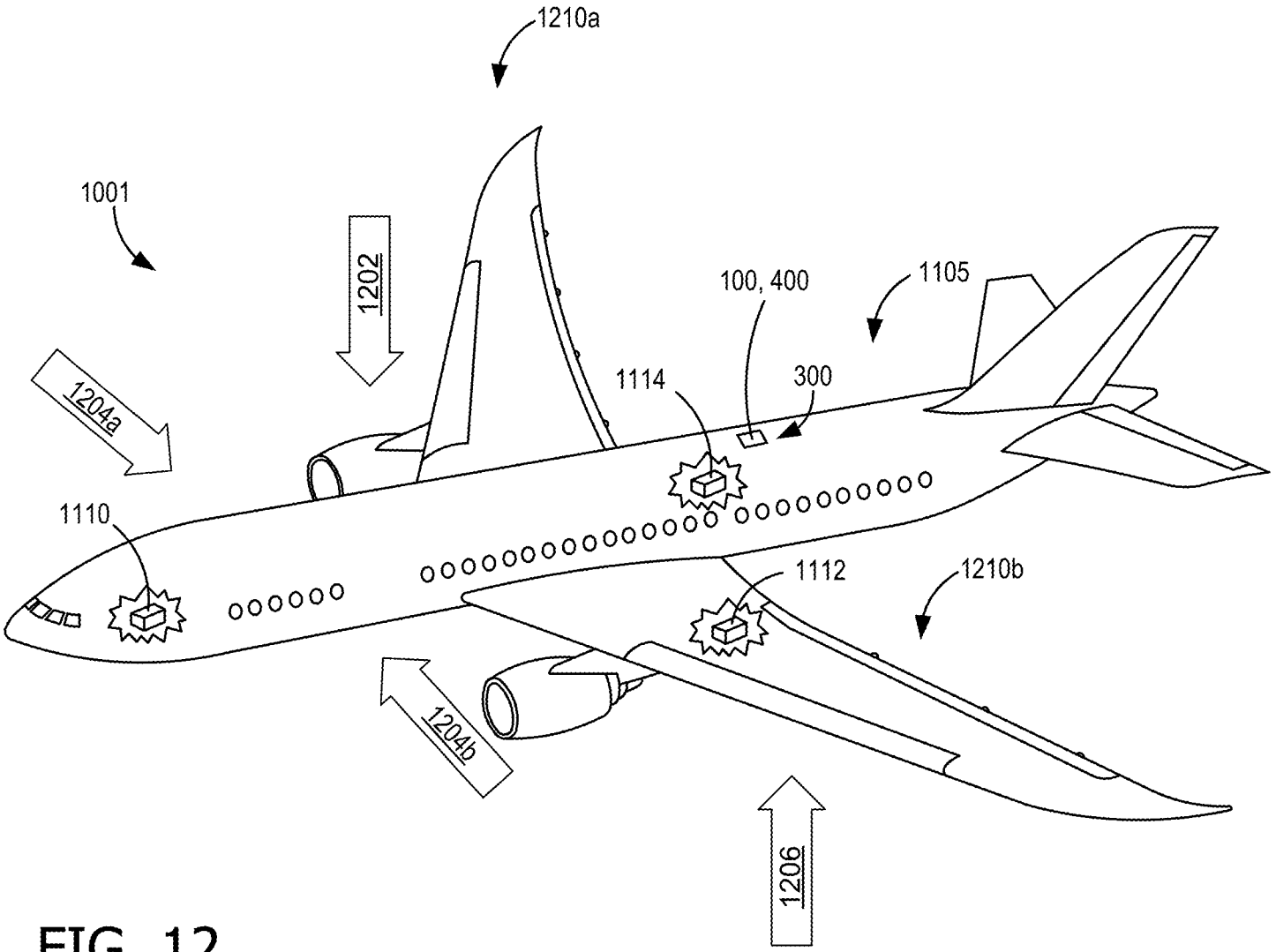
FIG. 12 is another schematic perspective view of the aircraft 1001 of FIG. 10 with an installed antenna assembly 100 of FIG. 1.

FIG. 12 is another schematic perspective view of the aircraft 1001 of FIG. 10 with an installed antenna assembly 100 of FIG. 1. An implementation of the transmitting arrangement 400 is included, to provide RF operations for the antenna assembly 100, although the signal source 402 and the receiver 404 is located remotely from the antenna assembly 100 (e.g, within the interior 1106 of the aircraft 1001). The non-planar surface 310 upon which the antenna assembly 100 is installed in a bent, conformal configuration is the exterior 1105 of the aircraft 1001.

The exterior 1105 of the aircraft 1001 has an upward-facing surface 1202, side-facing surfaces 1204*a* and 1204*b*, and a downward facing surface 1206. The antenna assembly 100 is placed on, for example, wings 1210*a* or 1210*b*, or elsewhere on the aircraft 1001. For communication with ground stations, the antenna assembly 100 is placed on the downward facing surface 1206. For communication with satellites, the antenna assembly 100 is placed on the upward-facing surface 1202. For communication with other aircraft, the antenna assembly 100 is placed on the side-facing surfaces 1204*a* and 1204*b*.

The following paragraphs describe further aspects of the disclosure:

A1. An antenna assembly comprising:

a first conductive element having a bowtie shape, the first conductive element on a dielectric material at a first layer;

a feed point within the bowtie shape;

a second conductive element configured as a feed line, the second conductive element on the dielectric material at a second layer, wherein the second conductive element is electrically coupled to the first conductive element at least at the feed point, independently of direct electrical contact between the first conductive element and the second conductive element, and wherein the first conductive element and the second conductive element together form an electrically coupled bowtie antenna; and a ground plane on the dielectric material at a third layer.

A2. The antenna assembly of A1, wherein the second conductive element has no direct electrical contact with the first conductive element, such that coupling of the second conductive element with the first conductive element comprises electric fields within the dielectric material between the first conductive element and the second conductive element, thereby reducing a risk of performance degradation caused by mechanical damage at the feed point.

A3. The antenna assembly of A1, wherein the bowtie shape has a width of a third of a wavelength at an operating frequency of the antenna assembly.

A4. The antenna assembly of A1, wherein the bowtie shape has a length of an eighth of a wavelength at an operating frequency of the antenna assembly.

A5. The antenna assembly of A1, wherein the bowtie shape is defined by a gap within the first conductive element.

A6. The antenna assembly of A5, wherein the first conductive element has a width of a half of a wavelength at an operating frequency of the antenna assembly, and wherein the first conductive element has a length that is no greater than the width of the first conductive element.

A7. The antenna assembly of A1, wherein the bowtie shape is defined by an outer edge of the first conductive element.

A8. The antenna assembly of A1, wherein an operating frequency of the antenna assembly is an X-band frequency.

A9. The antenna assembly of A1, wherein a distance between the first layer and the third layer is between three sixteenths and five sixteenths of a wavelength at an operating frequency of the antenna assembly.

A10. The antenna assembly of A1, wherein the second layer is between the first layer and the third layer.

A11. The antenna assembly of A1, wherein the antenna assembly is flexible, thereby permitting the antenna assembly to conform to a non-planar surface.

A12. The antenna assembly of A1, wherein the dielectric material comprises a set of stacked dielectric layers.

A13. The antenna assembly of A1, wherein the first conductive element, the second conductive element, or the ground plane comprises copper.

A14. The antenna assembly of A1, further comprising:

a matching component coupled to the second conductive element disposed opposite the feed point.

A15. An aircraft comprising:

an antenna assembly, the antenna assembly comprising:

a first conductive element having a bowtie shape, the first conductive element on a dielectric material at a first layer;

a feed point within the bowtie shape;

a second conductive element configured as a feed line, the second conductive element on the dielectric material at a second layer, wherein the second conductive element is electrically coupled to the first conductive element at least at the feed point, independently of direct electrical contact between the first conductive element and the second conductive element, and wherein the first conductive element and the second conductive element together form an electrically coupled bowtie antenna; and a ground plane on the dielectric material at a third layer; and a non-planar surface on an exterior of the aircraft, wherein the antenna assembly conforms to the non-planar surface.

A16. The aircraft of A15, further comprising:

a signal source or receiver coupled to the antenna assembly.

A17. A method of making an antenna assembly, the method comprising:

providing a first dielectric layer and a second dielectric layer;

providing a first conductive element on the first dielectric layer, the first conductive element having a bowtie shape, the bowtie shape having a feed point;

providing a second conductive element on the first or second dielectric layer, the second conductive element configured as a feed line;

stacking the first and second dielectric layers to couple the second conductive element to the first conductive element at least at the feed point of the bowtie shape, thereby forming an electrically coupled bowtie antenna, wherein the electrical coupling is independent of direct electrical contact between the first conductive element and the second conductive element; and providing a ground plane on the stacked dielectric layers, the ground plane disposed on the stacked dielectric.

A18. The method of A17, further comprising:

affixing the antenna assembly to a non-planar surface on an exterior of an aircraft such that the antenna assembly conforms to the non-planar surface.

A19. The method of A18, further comprising:

after affixing the antenna assembly to the aircraft, tuning the antenna assembly using a matching component coupled to the second conductive element.

A20. The method of A19, further comprising:

after affixing the antenna assembly to the aircraft, during operation of the aircraft, transmitting a signal using the antenna assembly.

A21. The method of A19, further comprising:

after affixing the antenna assembly to the aircraft, during operation of the aircraft, receiving a signal using the antenna assembly.

A21. The method of A19, further comprising:

after affixing the antenna assembly to the aircraft, dynamically tuning the antenna assembly using a matching component coupled to the second conductive element.

A22. The antenna assembly of A1, wherein an operating frequency of the antenna assembly is in a band selected from the list consisting of:

HF, VHF, UHF, L, S, C, and X.

A23. The antenna assembly of A7, wherein the bowtie shape is filled in with the first conductive element.

A24. The aircraft of A15, further comprising:

a power amplifier disposed between the signal source and the antenna assembly.

A25. The aircraft of A24, further comprising:

a matching component disposed between the power amplifier and the second conductive element.

A26. The aircraft of A25, further comprising:

a tuning component coupled to the matching component for dynamically tuning the matching component.

When introducing elements of aspects of the disclosure or the implementations thereof, the articles "a," "an," "the," and "said" are intended to mean that there are one or more of the elements. The terms "comprising," "including," and "having" are intended to be inclusive and mean that there could be additional elements other than the listed elements. The term "implementation" is intended to mean "an example of" The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. An antenna assembly comprising:

a dielectric material comprising a first layer, a second layer, and a third layer;

a first conductive element having a bowtie shape, the first conductive element at the first layer;

a feed point within the bowtie shape;

a second conductive element configured as a feed line, the second conductive element at the second layer;

wherein the second conductive element is electrically coupled to the first conductive element at least at the feed point, independently of direct electrical contact between the first conductive element and the second conductive element; and wherein the first conductive element and the second conductive element together form an electrically coupled bowtie antenna; and a ground plane at the third layer.

2. The antenna assembly of claim 1, wherein the second conductive element has no direct electrical contact with the first conductive element, such that electrical coupling of the second conductive element with the first conductive element comprises electric fields within the dielectric material between the first conductive element and the second conductive element, thereby reducing a risk of electrical performance degradation caused by mechanical damage at the feed point.

3. The antenna assembly of claim 1, wherein the bowtie shape has a width of a third of a wavelength at an operating frequency of the antenna assembly.

4. The antenna assembly of claim 1, wherein the bowtie shape has a length of an eighth of a wavelength at an operating frequency of the antenna assembly.

5. The antenna assembly of claim 1, wherein the bowtie shape is defined by a gap within the first conductive element.

6. The antenna assembly of claim 5, wherein the first conductive element has a width of a half of a wavelength at an operating frequency of the antenna assembly, and wherein the first conductive element has a length that is no greater than the width of the first conductive element.

7. The antenna assembly of claim 1, wherein the bowtie shape is defined by an outer edge of the first conductive element.

8. The antenna assembly of claim 1, wherein an operating frequency of the antenna assembly is an X-band frequency.

9. The antenna assembly of claim 1, wherein a distance between the first layer and the third layer is between three sixteenths and five sixteenths of a wavelength at an operating frequency of the antenna assembly.

10. The antenna assembly of claim 1, wherein second conductive element only extends in the second layer.

11. The antenna assembly of claim 1, wherein the antenna assembly is flexible, thereby permitting the antenna assembly to conform to a non-planar surface.

12. The antenna assembly of claim 1, wherein the dielectric material comprises a set of stacked dielectric layers.

13. The antenna assembly of claim 1, wherein the first conductive element, the second conductive element, or the ground plane comprises copper.

14. The antenna assembly of claim 1, further comprising:

a matching component coupled to the second conductive element disposed opposite the feed point.

15. An aircraft comprising:

an antenna assembly, the antenna assembly comprising:

a dielectric material comprising a first layer, a second layer, and a third layer;

a first conductive element having a bowtie shape, the first conductive element at the first layer;

a feed point within the bowtie shape;

a second conductive element configured as a feed line, the second conductive element at the second layer, wherein the second conductive element is electrically coupled to the first conductive element at least at the feed point, independently of direct electrical contact between the first conductive element and the second conductive element, and wherein the first conductive element and the second conductive element together form an electrically coupled bowtie antenna; and a ground plane at the third layer; and a non-planar surface on an exterior of the aircraft, wherein the antenna assembly conforms to the non-planar surface.

16. The aircraft of claim 15, further comprising:

a signal source or receiver coupled to the antenna assembly.

17. A method of making an antenna assembly, the method comprising:

providing a first dielectric layer and a second dielectric layer;

providing a first conductive element on the first dielectric layer, the first conductive element having a bowtie shape, the bowtie shape having a feed point;

providing a second conductive element on the first or second dielectric layer, the second conductive element configured as a feed line;

stacking the first and second dielectric layers to couple the second conductive element to the first conductive element at least at the feed point of the bowtie shape, thereby forming an electrically coupled bowtie antenna, wherein the coupling is independent of direct electrical contact between the first conductive element and the second conductive element; and providing a ground plane on the stacked dielectric layers, the ground plane disposed on the stacked dielectric layers.

18. The method of claim 17, further comprising:

affixing the antenna assembly to a non-planar surface on an exterior of an aircraft such that the antenna assembly conforms to the non-planar surface.

19. The method of claim 18, further comprising:

after affixing the antenna assembly to the aircraft, tuning the antenna assembly using a matching component coupled to the second conductive element.

20. The method of claim 18, further comprising:

after affixing the antenna assembly to the aircraft, during operation of the aircraft, transmitting a signal using the antenna assembly.

* * * * *